US011724778B2

(12) United States Patent
Atallah et al.

(10) Patent No.: US 11,724,778 B2
(45) Date of Patent: Aug. 15, 2023

(54) SYSTEMS AND METHODS FOR SECURING AND REMOVING TAIL CHAINS FROM MOORING LINES

(71) Applicants: Nick Atallah, Goleta, CA (US); Tony Cepeda, Santa Maria, CA (US); Kanghua Sun, Ventura, CA (US)

(72) Inventors: Nick Atallah, Goleta, CA (US); Tony Cepeda, Santa Maria, CA (US); Kanghua Sun, Ventura, CA (US)

(73) Assignee: Bardex Corporation, Goleta, CA (US)

( * ) Notice: Subject to any disclaimer, the term of this patent is extended or adjusted under 35 U.S.C. 154(b) by 118 days.

(21) Appl. No.: 17/380,810

(22) Filed: Jul. 20, 2021

(65) Prior Publication Data

US 2022/0017183 A1 Jan. 20, 2022

Related U.S. Application Data

(60) Provisional application No. 63/054,100, filed on Jul. 20, 2020.

(51) Int. Cl.

| | |
|---|---|
| ***B63B 21/04*** | (2006.01) |
| ***B63B 21/20*** | (2006.01) |
| ***B63B 21/10*** | (2006.01) |
| ***B63B 21/18*** | (2006.01) |

(52) U.S. Cl.

CPC ..... *B63B 21/04* (2013.01); *B63B 21/10* (2013.01); *B63B 21/18* (2013.01); *B63B 21/20* (2013.01)

(58) Field of Classification Search

CPC ..... B63B 21/04; B63B 21/10; B63B 21/18; B63B 21/20

See application file for complete search history.

(56) References Cited

U.S. PATENT DOCUMENTS

| | | | |
|---|---|---|---|
| 5,845,893 | A | 12/1998 | Groves |
| 6,983,714 | B2 | 1/2006 | Dove et al. |
| 7,059,262 | B2 | 6/2006 | Dove et al. |
| 8,915,205 | B2 | 12/2014 | Miller et al. |
| 9,003,994 | B2 | 4/2015 | Leverette et al. |
| 9,126,659 | B2 | 9/2015 | Miller et al. |

(Continued)

FOREIGN PATENT DOCUMENTS

| | | | |
|---|---|---|---|
| WO | WO-2004050470 A2 * | 6/2004 | ..... B63B 21/16 |
| WO | 2016178584 A1 | 11/2016 | |

OTHER PUBLICATIONS

Notification of Transmittal of International Search Report and Written Opinion dated Oct. 22, 2021 (issued in PCT Application No. PCT/US2021/042425) [7 pages].

(Continued)

*Primary Examiner* — Anthony D Wiest

(74) *Attorney, Agent, or Firm* — Michael S. McCoy; Amatong McCoy LLC

(57) ABSTRACT

Methods and systems for handling a tail chain of a mooring line are provided. A fairlead stopper having a tail chain support is provided for removing and reconnecting tail chain to the mooring line. The tail chain support is positioned to receive the tail chain of the mooring line, and includes a first chain coupler to secure a first portion of the mooring line, a second chain coupler to secure a second portion of the mooring line, and a working zone between the chain couplers for removing and reconnecting the tail chain.

30 Claims, 10 Drawing Sheets

(56) References Cited

U.S. PATENT DOCUMENTS

| | | | |
|---|---|---|---|
| 9,340,261 | B2 | 5/2016 | Macrae |
| 10,272,973 | B2 | 4/2019 | O'Rourke |
| 10,676,160 | B2 | 6/2020 | Atallah et al. |
| 2002/0189522 | A1 | 12/2002 | Dove et al. |
| 2004/0231579 | A1 | 11/2004 | Macrae et al. |
| 2005/0241558 | A1 | 11/2005 | Barlow |
| 2010/0024706 | A1 | 2/2010 | Foo et al. |
| 2012/0160146 | A1 | 6/2012 | Miller et al. |
| 2012/0266800 | A1 | 10/2012 | Edelson et al. |
| 2014/0026796 | A1 | 1/2014 | Leverette et al. |
| 2015/0014614 | A1 | 1/2015 | Lisland et al. |
| 2015/0259043 | A1 | 9/2015 | Bauer |
| 2016/0185427 | A1 | 6/2016 | Macrae |
| 2017/0259886 | A1 | 9/2017 | O'Rourke et al. |
| 2018/0086421 | A1 | 3/2018 | O'Rourke et al. |
| 2019/0092599 | A1 | 3/2019 | Sun |
| 2020/0055569 | A1 | 2/2020 | Atallah et al. |
| 2020/0130783 | A1 | 4/2020 | Taylor |

OTHER PUBLICATIONS

Hywind Scotland Pilot Park Environmental Statement; Apr. 2015; 462 Pages; Statoil; Relevant Pages Section 4.4.2.

* cited by examiner

SYSTEMS AND METHODS FOR SECURING AND REMOVING TAIL CHAINS FROM MOORING LINES

CROSS-REFERENCE TO RELATED APPLICATIONS

The present application claims the benefit of U.S. Provisional Patent Application No. 63/054,100 (expired), filed on Jul. 20, 2020, and entitled "Handling Tail Chains of Mooring Lines," the entirety of which is incorporated herein by reference.

FIELD

The present disclosure relates to methods and systems for mooring vessels and tensioning mooring lines. In particular, the present disclosure relates to methods and systems for handling (e.g., cutting, disconnecting, reconnecting) tail chains of mooring lines.

BACKGROUND

In many applications, floating vessels require mooring, such as in offshore drilling platform applications or offshore wind turbines with floating foundations. The mooring lines typically require at least some tensioning to securely moor the vessel. After the mooring line is secured at the desired tension, there is often excess mooring chain beyond the point where the mooring line is secured. It is desirable to remove this excess mooring chain, also referred as "tail chain." When the paying-out of additional mooring line is required, it is sometimes desirable to reconnect the tail chain with the mooring line.

BRIEF SUMMARY

The present disclosure includes a mooring system. The mooring system includes a fairlead stopper having a tail chain support that is positioned to receive tail chain of mooring chain. The tail chain support has a first chain coupler configured to secure mooring chain at a first position on the tail chain support and a second chain coupler configured to secure mooring chain at a second position on the tail chain support. The first position is spaced apart from the second position such that at least one link of mooring chain is positionable between the first and second positions on the tail chain support.

The present disclosure includes a moored system. The moored system includes a floating vessel, a fairlead stopper coupled with the floating vessel, and a mooring chain coupled with the fairlead stopper and with an anchor. The fairlead stopper includes a tail chain support that is positioned to receive tail chain of the mooring chain. The tail chain support includes a first chain coupler configured to secure the mooring chain at a first position on the tail chain support and a second chain coupler configured to secure the mooring chain at a second position on the tail chain support. The first position is spaced apart from the second position such that at least one link of the mooring chain is positionable between the first and second positions on the tail chain support.

The present disclosure includes a method of mooring a floating vessel. The method includes paying-out a mooring chain from a fairlead stopper coupled with the floating vessel, hauling-in the mooring chain to the fairlead stopper, or combinations thereof. The mooring chain is paid-out or hauled-in until the mooring chain has a first tension. The method includes securing the mooring chain at the first tension with the fairlead stopper. With the mooring chain secured at the first tension, the method includes securing a tail chain of the mooring chain to a tail chain support of the fairlead stopper. Securing the tail chain includes securing a first chain link of the tail chain at a first position on the tail chain support and securing a second chain link of the tail chain at a second position on the tail chain support. At least one chain link of the tail chain is positioned between the first and second chain links. With the tail chain secured to the fairlead stopper, the method includes removing the at least one chain link positioned between the first and second chain links. After removing the at least one chain link, the first chain link is coupled with the mooring chain and the second chain link is coupled with a length of the tail chain that is disconnected from the mooring chain.

BRIEF DESCRIPTION OF THE DRAWINGS

So that the manner in which the features and advantages of the systems and methods of the present disclosure may be understood in more detail, a more particular description, briefly summarized above, may be had by reference to the embodiments thereof which are illustrated in the appended drawings that form a part of this specification. It is to be noted, however, that the drawings illustrate only various exemplary embodiments and are, therefore, not to be considered limiting of the disclosed concepts as it may include other effective embodiments as well.

DETAILED DESCRIPTION

Certain embodiments of the present disclosure include methods and systems for mooring floating vessels and for tensioning mooring lines thereof, including methods and systems for handling tail chains of mooring lines. Handling tail chain includes cutting or otherwise disconnecting tail chain from mooring line, connecting tail chain to mooring line, pinning tail chain to a fairlead stopper, unpinning tail chain from a fairlead stopper, or combinations thereof. In some such embodiments, the method includes tensioning a mooring line to securely moor a floating vessel. After the mooring line is secured (e.g., latched) at a desired tension, the method includes removing (e.g., cutting or otherwise disconnecting) excess mooring chain (i.e., tail chain) past a point where the mooring line is secured to a fairlead stopper. In some embodiments, the method includes paying-out additional mooring line by connecting tail chain (e.g., reconnecting the removed tail chain) with the mooring line and then paying-out additional mooring line.

Fairlead Stopper with a Tail Chain Support

Some embodiments of the present disclosure include a fairlead stopper having a tail chain support, to a floating vessel including such a fairlead stopper, and to methods of making and using the same.

Figure 1:
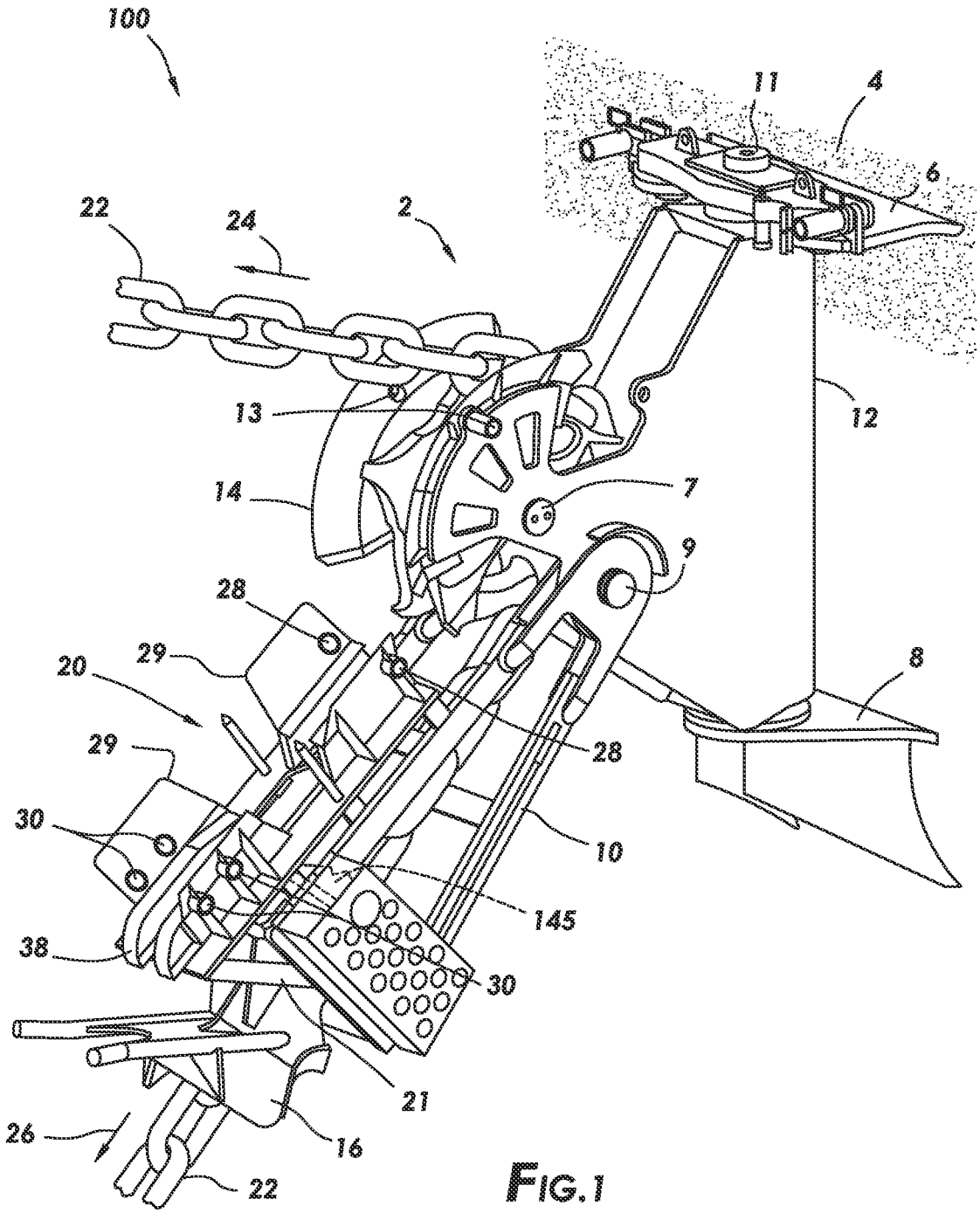
FIG. 1 depicts a fairlead stopper, in accordance with an embodiment of the present disclosure, coupled with a floating vessel and a mooring line during hauling-in or paying-out of the mooring line.
Figure 2:
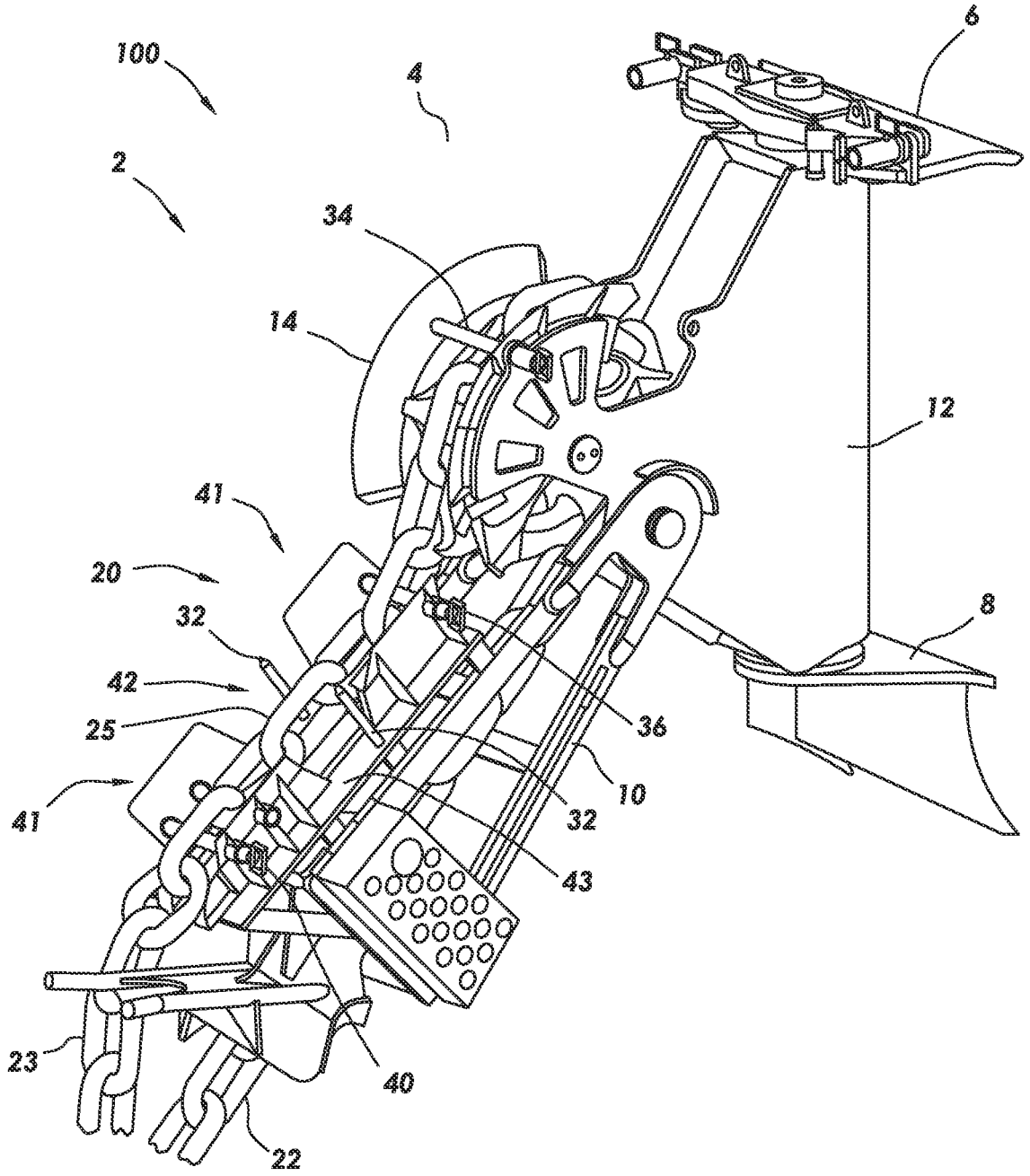
FIG. 2 depicts the fairlead stopper of FIG. 1, with the mooring line on a tail chain support of the fairlead stopper.

With reference to FIGS. 1 and 2, a floating vessel having a fairlead stopper with a tail chain support in accordance with one embodiment of the present disclosure is depicted. Mooring system 100 includes floating vessel 4 (only a portion of which is depicted, for context). Floating vessel 4 may be an oil drilling or production platform, a floating production storage offloading (FPSO) vessel, an offshore floating wind power foundation, or a floating fish farm. The floating vessels disclosed herein are not limited to these particular floating vessels, and may be another offshore floating structure.

Mooring system 100 includes fairlead stopper 2 coupled with floating structure 4. Fairlead stopper 2 includes chainwheel housing 12 coupled (e.g., mounted) with floating structure 4 via brackets 6 and 8. In some embodiments, the fairlead stoppers disclosed herein are coupled with the floating vessel such that the fairlead stoppers are movable (e.g., pivotable) with respect to the floating vessel. As shown in FIG. 1, brackets 6 and 8 are pivotably coupled with chainwheel housing 12 via pivot pin 11, such that chainwheel housing 12 is pivotable relative to floating vessel 4.

Chainwheel housing 12 may be or include a frame configured to retain a chainwheel of fairlead stopper 2. Chainwheel 14 is rotatably coupled with chainwheel housing 12, such that chainwheel 14 rotates with respect to chainwheel housing 12 about axle 7. Chainwheel 14 is configured to engage with mooring chain 22 such that mooring chain 22 can pass over chainwheel 14 as chainwheel 14 rotates relative to chainwheel housing 12. The chainwheel housings disclosed herein may include a structure for securing mooring chain thereto. In FIG. 1, chainwheel housing 12 includes pin holes 13 configured to receive pin 34 (shown in FIG. 2) to secure a position of chainwheel 14 relative to chainwheel housing 12. The methods and systems disclosed herein are not limited to securing the chainwheel to the chainwheel housing via pins and pin holes, and may include other ways of securing chainwheels. When secured to chainwheel housing 12 via pin 34, chainwheel 14 is prevented from rotating relative to chainwheel housing 12. When not secured to chainwheel housing 12, chainwheel 14 may rotate relative to chainwheel housing 12.

The chainwheel disclosed herein rotates as the mooring line is hauled-in or paid-out, guiding the mooring line. In some embodiments, the chairwheel has one or more (e.g., two) wildcat profiles that have surface contours designed to engage with the chain, and includes chain contact areas shaped to follow (mate with) the shape of the chain links; thereby, minimizing local stresses. The chainwheel can be rotatably coupled with the chainwheel housing, such that the chainwheel rotates relative to the chainwheel housing, guiding the mooring line during hauling-in and paying-out. While describe as used for moving chain, the chainwheel is not limited to coupling with and moving chain, and may move other types of mooring line. In some embodiments, the chain wheel disclosed herein is a dual chainwheel capable of engaging with and guiding at least two different sized chains. In other embodiments, the chainwheel is a single chainwheel designed for use with just one chain size. In embodiments where the chainwheel is a dual chainwheel, the dual chainwheel is configured to provide for a seamless transition from engagement with a smaller adjustment chain to engagement with a mooring line. A connector (link coupler) connects between the two different sized chains and interfaces on the dual chainwheel to facilitate the transition between the chain sizes. For example, and without limitation, the chainwheel may be the same as or similar to the chain wheel disclosed in U.S. Patent Publication No. 2019/0092599 (the '599 Publication). Also, the link coupler disclosed in the '599 Publication may be used to connect the smaller adjustment chain with the larger mooring chain. Use of the link coupler and dual chainwheel can ensure that the two different chain sizes stay "clocked" on the chainwheel and fall into the appropriate pockets of the chainwheel for chain support; thereby, at least reducing bending on the chain links.

Fairlead stopper 2 includes latch housing 10. Latch housing 10 may be or include a frame that is configured to retain latches of fairlead stopper 2. The latches 145 are positioned in latch housing 10 to grip a link of mooring chain 22 passing through latch housing 10 to maintain a position of mooring chain 22 relative to fairlead stopper 2. Latch housing 10 includes chain guide 16, such as a guide shoe, for guiding mooring chain 22 into and through latch housing 10 towards chainwheel 14. Latch housing 10 is pivotably coupled with chainwheel housing 12 via pivot pin 9, such that latch housing 10 is pivotable relative to chainwheel housing 12. While the latch housing and chainwheel housing are shown as separate, but coupled, frames in FIGS. 1 and 2, the fairlead stoppers disclosed herein are not limited to such an arrangement and may, for example, include a unitary frame that serves as both the latch housing and chainwheel housing.

Mooring chain 22 can be hauled-in to tension mooring chain 22 by pulling mooring chain 22 along direction 24. For example, and without limitation, an anchor handling vessel (AHV), such as an anchor handling tug supply (AHTS) vessel, may haul-in mooring chain 22, such as via using winches on the AHV (not shown), Mooring chain 22 can be paid-out to decrease tension on mooring chain 22 by releasing mooring chain 22 along direction 26. For example, and without limitation, an AHV may pay-out mooring chain 22, such as via using winches on the AVH. Once the desired tension is achieved, mooring chain 22 can be latched into position using latches that are positioned within latch housing 10.

The portion of mooring chain 22 that extends out of latch housing 10 along direction 26 is referred to herein as the "lower end" of mooring chain 22. The lower end of mooring chain 22 may extend from fairlead stopper 2 toward the seabed (not show) and may be coupled with an anchor (not shown). The portion of mooring chain 22 that extends from chainwheel 14 along direction 24 is referred to herein as the "upper end" of mooring chain 22. During operations to increase or decrease tension of mooring chain 22, the upper end of mooring chain 22 may be coupled with, for example, a winch on an ARV. With mooring chain 22 latched into position at the desired tension by fairlead stopper 2, the upper end of mooring chain 22 may be released from the AHV and is referred to as the tail chain or bitter end of mooring chain 22.

Securing a Tail Chain to a Tail Chain Support

Fairlead stopper 2 includes tail chain support 20. The tail chain support is a structure configured to receive and secure portions of mooring chain 22, such as tail chain. The tail chain support may be or include a frame, bracket, rack, table (e.g., tail chain handling table), or combinations thereof, configured to receive, support, and/or secure tail chain of a mooring line. Tail chain support 20 includes a first chain coupler (pin 36 and pin holes 28) configured to secure mooring chain 22 at a first position on the tail chain support 20 and a second chain coupler (pin 40 and pin holes 30) configured to secure mooring chain 22 at a second position on the tail chain support 20. The first position is spaced apart from the second position such that at least one link (link 25, shown in FIG. 2) of mooring chain 22 is positionable between the first and second positions on the tail chain support 20.

Tail chain support 20 is coupled with latch housing 10. In some embodiments, tail chain support 20 is integral with or a portion of latch housing 10. In other embodiments, tail chain support 20 is a separate structure from latch housing 10. Tail chain support 20 includes frame 21. Frame 21 includes or defines track 38 upon which tail chain may be received by tail chain support 20. Pin holes 28 and 30 are each capable of receiving a pin for pinning a link of mooring chain 22 into position on tail chain support 20. Tail chain support 20 includes sidewalls 29, through which pin holes 28 and 30 are positioned. The methods and systems disclosed herein are not limited to securing tail chain to the tail chain support via pins and pin holes, and may include other chain couplers configured to secure chain. Tail chain support 20 is positioned, relative to chainwheel 14, to receive the upper end of mooring chain 22 that extends past chainwheel 14. That is, tail chain support 20 is positioned to receive the tail chain of mooring chain 22.

Tail chain support 20 includes or defines chain securement zones 41 where mooring chain 22 can be secured onto tail chain support 20. The chain securement zones disclosed herein may be portions of the tail chain support, that include structures capable of securing mooring line. In the embodiment shown in FIGS. 1 and 2, chain securement zones 41 include sidewalls 29 with pin holes 28 and 30 for receipt of pins 36 and 40 for pinning a link of mooring chain 22 into position on tail chain support 20. In FIG. 2, pins 36 and 40 extend through pin holes 28 and 30, respectively, and each of pins 36 and 40 extends through a different link of mooring chain 22; thereby, securing mooring chain 22 to tail chain support 20.

Tail chain support 20 includes or defines working zone 42. Working zone 42 is positioned between chain securement zones 41. Working zone 42 may be a space and/or structure configured to receive a tool for cutting or otherwise removing tail chain from mooring chain 22. Working zone 42 includes or defines a dock 43. Dock 43 is a structure configured to receive and securing a tool for cutting or otherwise removing tail chain from the mooring line. In FIGS. 1 and 2, dock 43 includes docking pins 32 positioned on and extending from frame 21 of tail chain support 20. Docking pins 32 are configured to couple with docking funnels of a tool or ROV (not shown), such that the tool or ROV can dock onto docking pins 32 and be positioned within working zone 42 for the cutting or otherwise disconnecting tail chain from mooring chain 22. The structure of dock 43 is not limited to including docking pins for mating with funnels, and may include other structures capable of receiving and securing a tool or ROV. In some embodiments, the arrangement is reversed, such that the docking pins are on the tool or ROV and the docking funnels that engage with the docking pins are on the dock in the working zone.

With reference to FIG. 2, mooring chain 22 is latched to fairlead stopper 2 via latches (not shown in FIG. 2) in latch housing 10. Mooring chain 22 is positioned on chainwheel 14. A position of chainwheel is secured via pin 34, which extends through pin holes 13, through chainwheel 14, and over a link of mooring chain 22. Thus, pin 34 prevents rotation of chainwheel 14 relative to chainwheel housing 12. The position of the chainwheel 14 is not limited to being secured via a pin, as shown, and may be secured via other methods. Mooring chain 22 extends from chainwheel 14 onto tail chain support 20, and is pinned thereto via pins 36 and 40. In some embodiments, an AHTS vessel is coupled with the upper end of mooring chain 22, and the AHTS vessel is used to lower the mooring chain 22 onto track 38 of tail chain support 20 for securement thereto. The "upper end" of mooring chain 22, extending from link 25, is tail chain 23 of mooring chain 22. In some embodiments, pins 34, 36 and 40 are secured via an ROV. With mooring chain 22 secured, as shown in FIG. 2, link 25 is positioned within working zone 42 to be cut or otherwise disconnected from mooring line.

Docking a Chain Removal Tool

Figure 3:
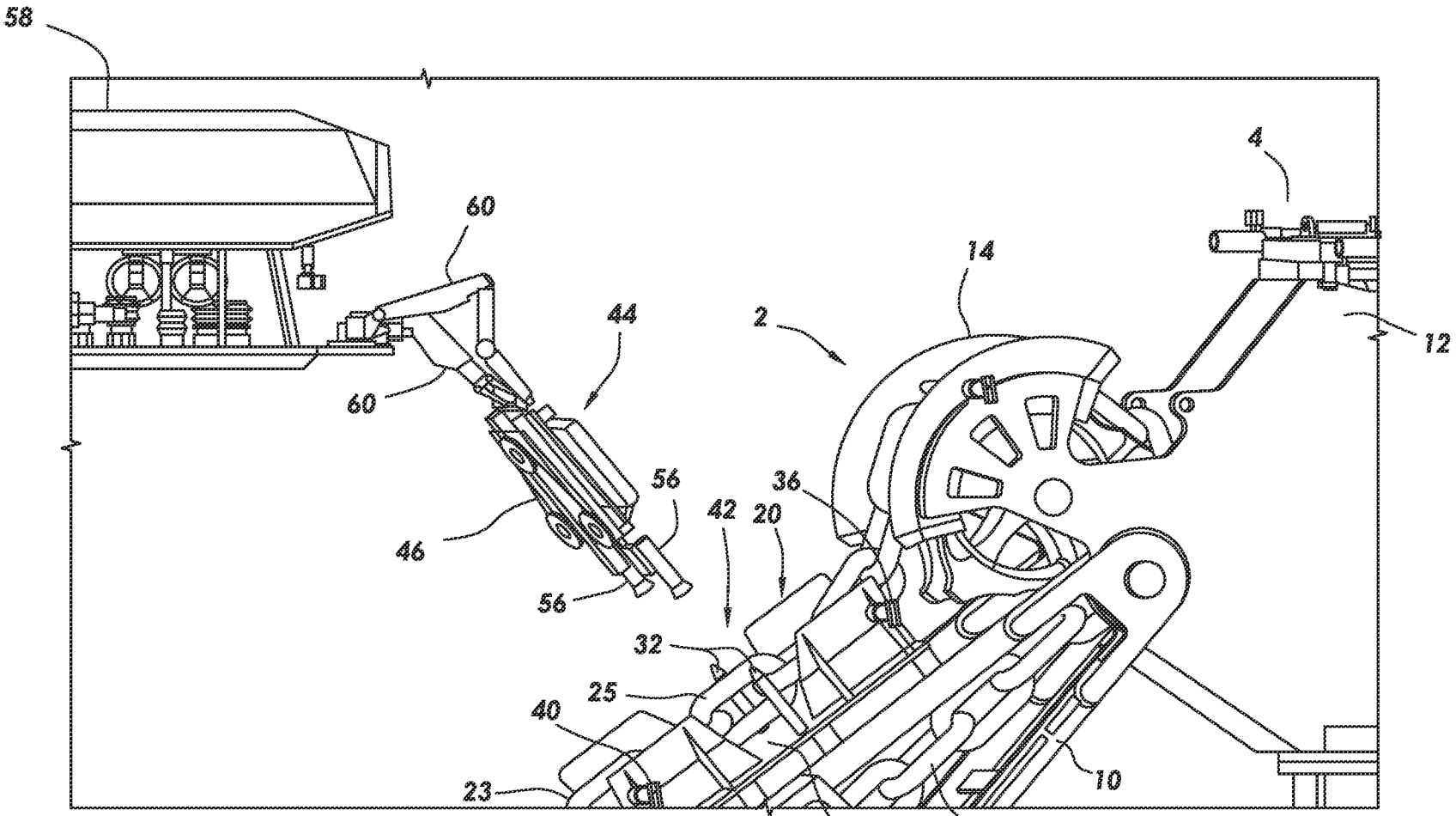
FIG. 3 depicts a remotely operated vehicle (ROV) manipulating a cutting system to position the cutting system on the fairlead stopper, in accordance with an embodiment of the present disclosure.
Figure 4:
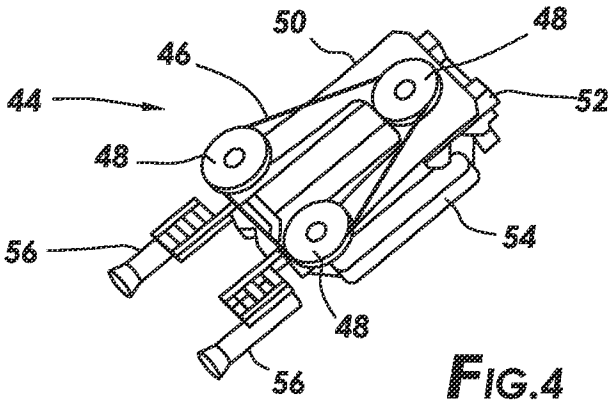
FIG. 4 depicts the cutting system of FIG. 3 in isolation from the ROV and the fairlead stopper.
Figure 6:
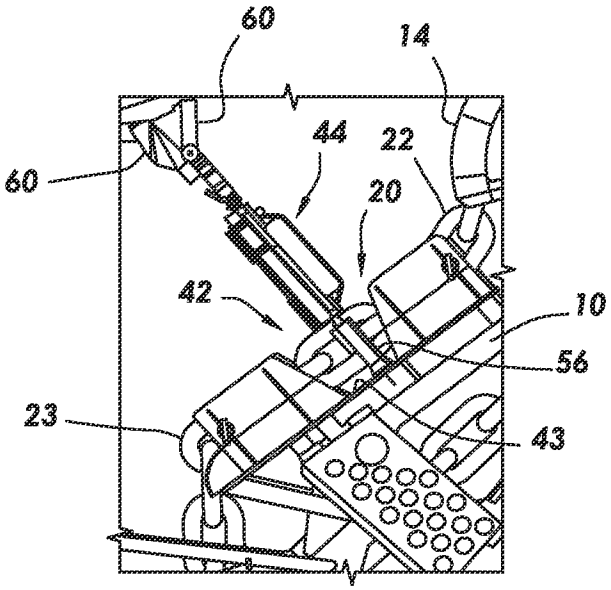
FIG. 6 depicts the cutting system of FIG. 5 after docking onto the tail chain support.
Figure 5:
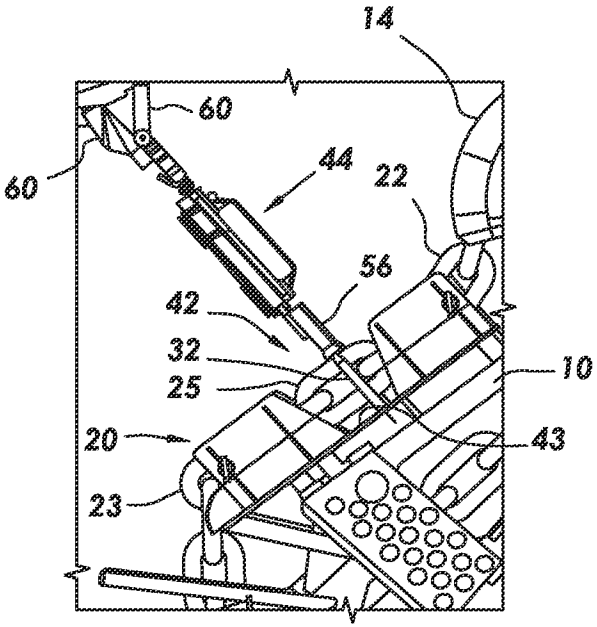
FIG. 5 depicts the ROV of FIG. 3 during docking of the cutting system onto the tail chain support.

With reference to FIGS. 3-6, the docking of a tail chain handling tool (e.g., a chain cutting tool. ROV) onto the tail chain support is depicted. A remotely operated vehicle, ROV 58, includes multiple manipulators 60 (arms) for use in performing tasks, such as removing tail chain. In FIG. 3, manipulators 60 are secured with chain cutter 44, and ROV 58 is shown approaching fairlead stopper 2 to dock chain cutter 44 on dock 43 by engaging docking funnels 56 with docking pins 32. As shown, chain cutter 44 is a diamond wire chain cutter, including diamond wire 46. However, the chain cutters disclosed herein are not limited to diamond wire chain cutters, and may include other chain cutting devices. As shown in FIG. 5, as ROV 58 approaches dock 43, docking funnels 56 engage with pins 32, such that docking pins 32 slide into docking funnels 56. FIG. 6 depicts ROV 58 with docking funnels 56 of chain cutter 44 fully engaged with docking pins 32.

FIG. 4 depicts chain cutter 44 in isolation from the ROV and fairlead stopper. Chain cutter 44 is a diamond wire cutting system (DWCS). However, the systems and methods disclosed herein are not limited to using a DWCS, and may include or use other cutting systems capable of cutting mooring lines. Chain cutter 44 includes diamond wire 46 coupled on sheaves 48. Sheaves 48 are coupled on first frame 50, and first frame 50 is coupled on second frame 52. Chain cutter 44 includes motor 54 coupled with second frame 52. Second frame 52 includes docking funnels 56 for docking onto docking pins 32. In operation, motor 54 drives rotation of sheaves 48, and rotation of sheaves 48 drives movement of diamond wire 16 about sheaves 48. First frame 50 is moveably coupled with second frame 52. In operation, with docking funnels 56 docked onto docking pins 32, first frame. 50 moves relative to second frame 52 such that diamond wire 16 moves toward the chain link 25 that is to be cut. As diamond wire 46 moves about sheaves 48 and engages the chain link 25, diamond wire 16 cuts through the chain link 25. In some embodiments, an ROV powers cutting system 44. In other embodiments, an umbilical extending from a surface of the floating vessel to chain cutter 44 powers the operation of chain cutter 44.

Removing a Chain Link

Figure 7B:
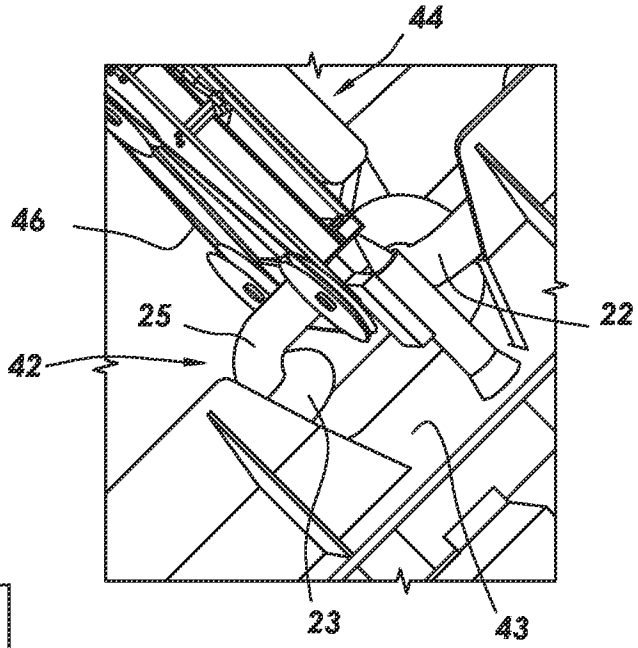
FIGS. 7A-7C depict the cutting system of FIG. 6 at sequential stages of cutting the mooring line.
Figure 7C:
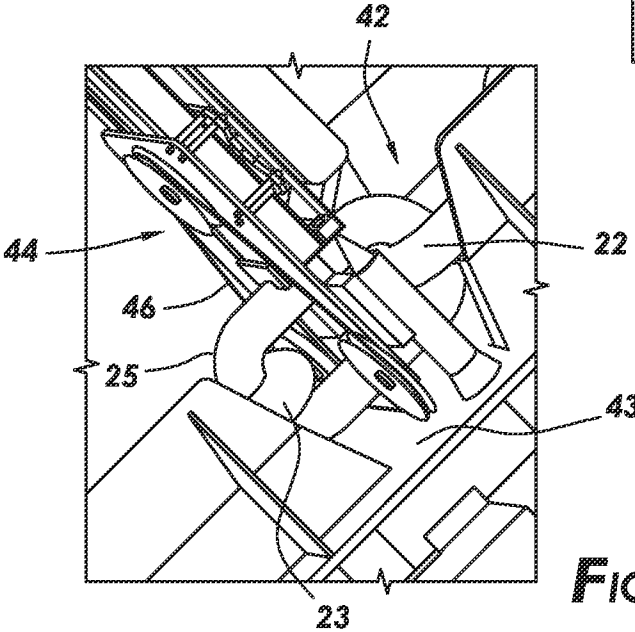
Figure 7A:
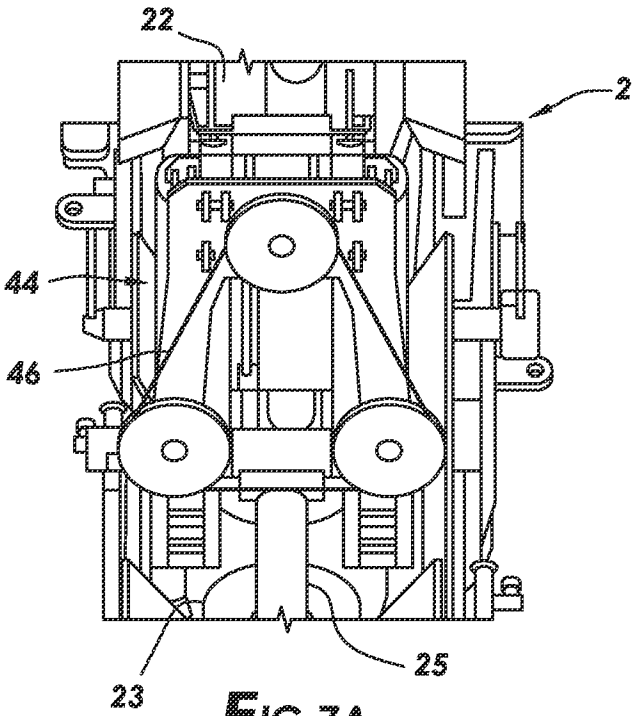

FIGS. 7A-7C depict chain cutter 44 positioned within working zone 42 and docked at dock 43 for cutting chain link 25 with diamond wire 46. In FIG. 7A, diamond wire 46 is positioned above chain link 25. The movement of diamond wire 46 cuts through chain link 25, and the ability to move first frame 50 relative to second frame 52 allows the diamond wire 46 to continue to cut through chain link 25. In FIG. 7B, diamond wire 46 has cut through a first half of chain link 25. In FIG. 7C, diamond wire 46 has cut through the entirety of chain link 25.

Removing Tail Chain

Figure 9:
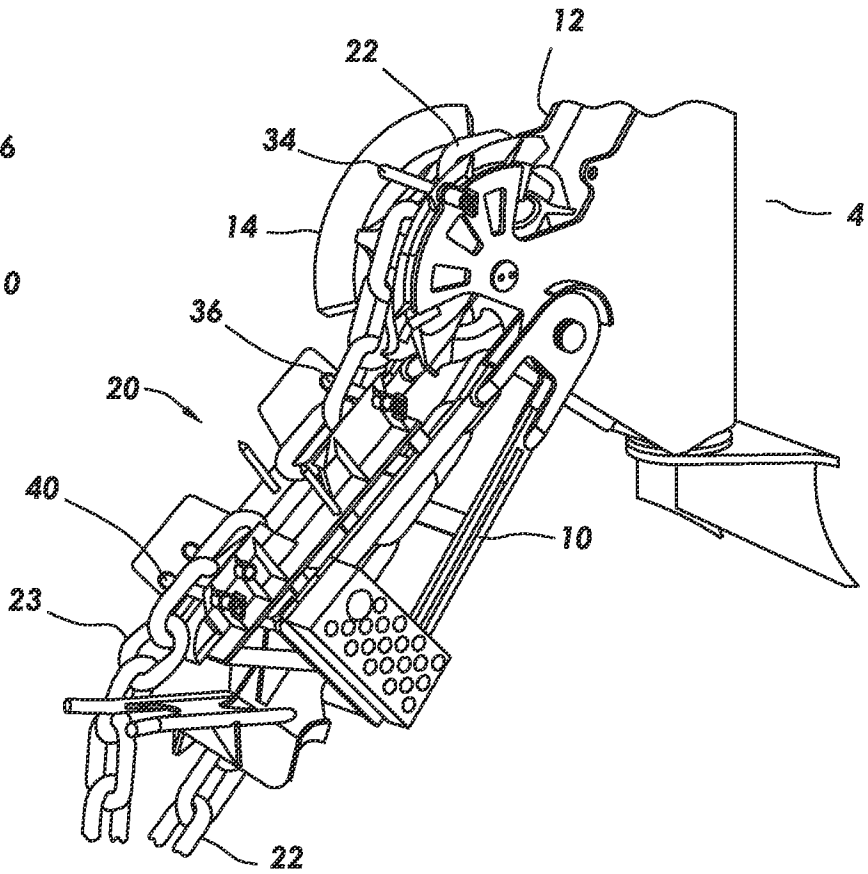
FIG. 9 depicts the fairlead stopper of FIG. 8 after the cut chain link is removed.
Figure 8:
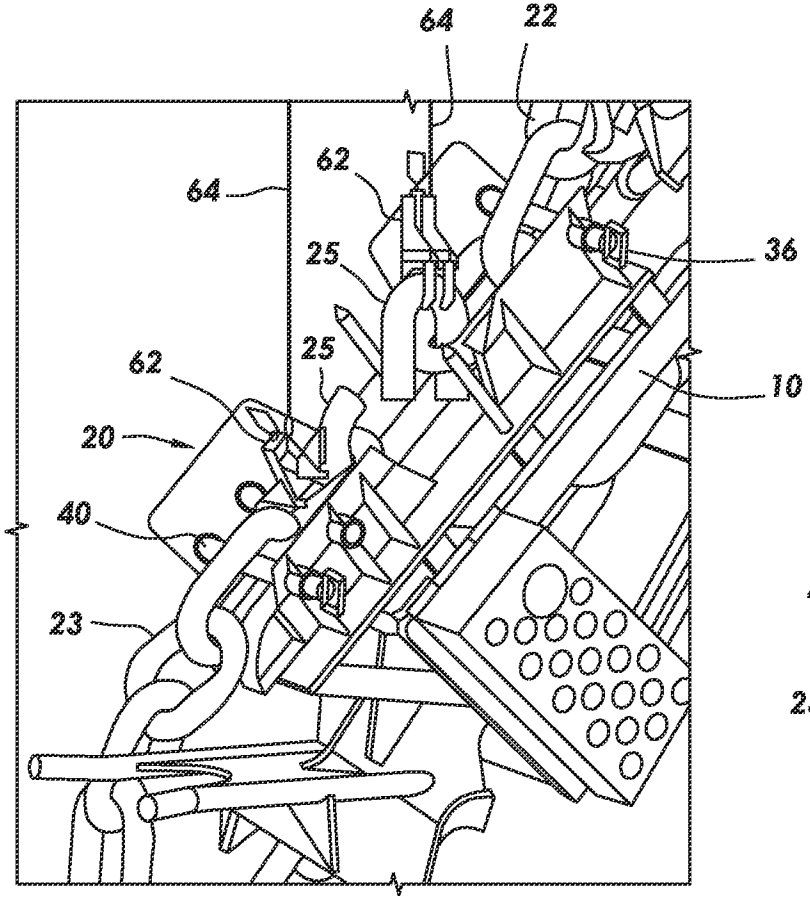
FIG. 8 depicts removal of a cut chain link to separate the tail chain from the remainder of the mooring line.
Figure 10:
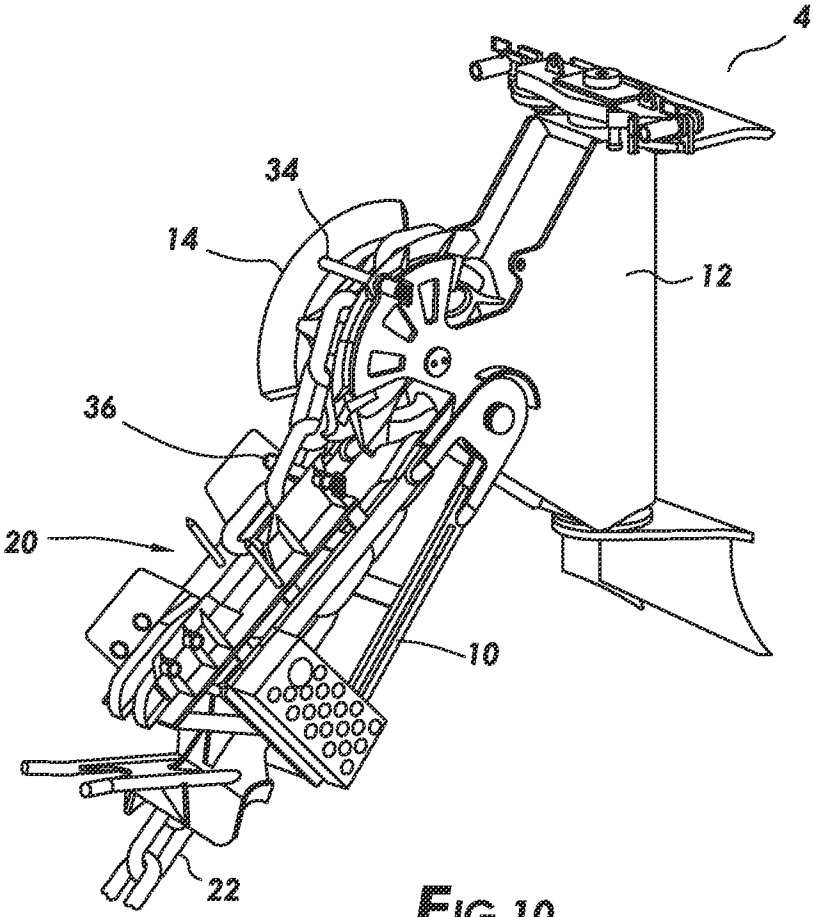
FIG. 10 depicts the fairlead stopper of FIG. 9 after the tail chain is removed from the tad chain support.

As shown in FIGS. 8-10, after cutting chain link 25, portions of chain link 25 are removed from mooring chain 22 and tail chain 23. In the embodiment shown, chain clamps 62 are lowered on wires 64 (e.g., from a winch on an AHV) to retrieve the halves of chain link 25. Upon cutting and removal of chain link 25, tail chain 23 is maintained secured to tail chain support 20 via pin 40, and mooring chain 22 is maintained secured to tail chain support 20 via pin 36. After removal of chain link 25, tail chain 23 is removed. Tail chain 23 is removed by removing pin 40 to release tail chain 23 from tail chain support 20. The removal of pin 40 may be facilitated by an ROV, for example. The removal of tail chain 23 may be facilitated by pulling the tail chain 23 onto an AHV, such as via using a winch.

Reconnecting Tail Chain

Figure 11:
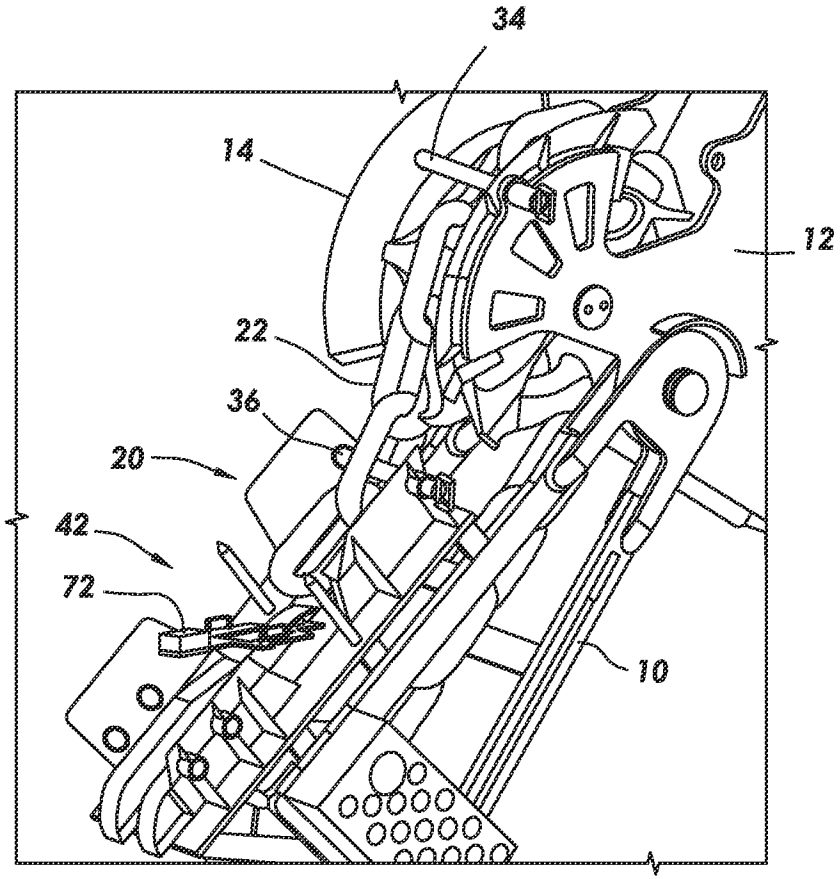
FIG. 11 depicts an insert piece being positioned onto the tail chain support for use in connecting tail chain to the mooring line.
Figure 12:
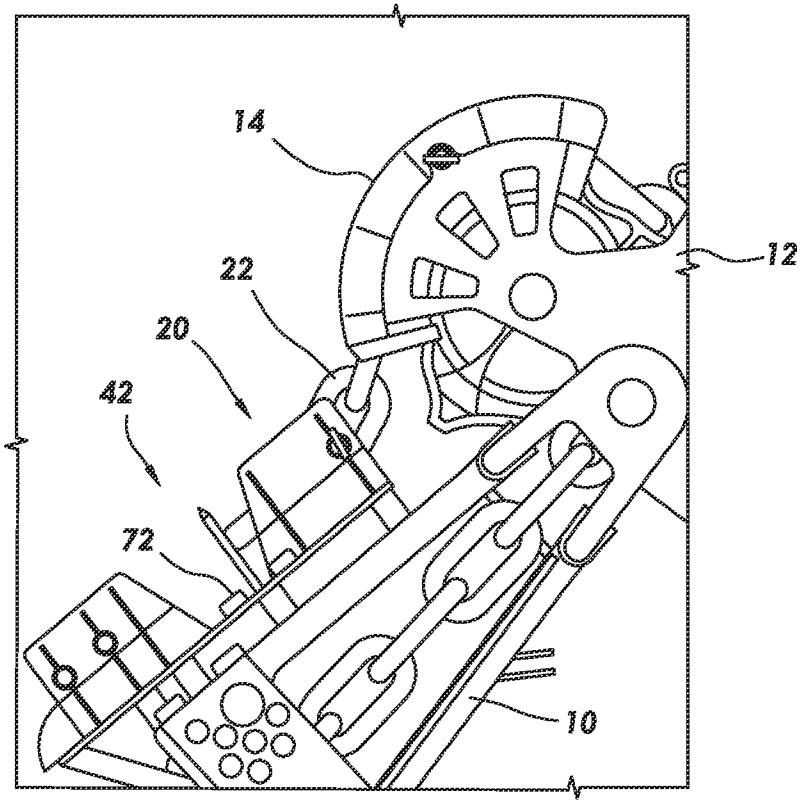
FIG. 12 depicts the insert piece of FIG. 11 after connection with the tail chain support.

In some embodiments, additional chain, such as previously removed tail chain, is attached to the mooring line, such as to payout additional mooring line. One embodiment of attaching additional chain to the mooring line is illustrated in FIGS. 11-17. As shown in FIG. 11, mooring chain 22 is secured to tail chain support 20 via pin 36, and chainwheel 14 is secured in a static position via pin 34. An alignment insert 72 is positioned on tail chain support 20 within working zone 42. The alignment insert 72 has a shape that is configured to position a D-link for engagement with both mooring chain 22 and additional chain. FIG. 12 shows alignment insert 72 positioned on tail chain support 20. Alignment insert 72 may be secured on to tail chain support 20. While alignment insert 72 is shown as a separate structure that is attached to tail chain support 20, in other embodiments the alignment insert disclosed herein may be integral with the tail chain support.

Figure 13:
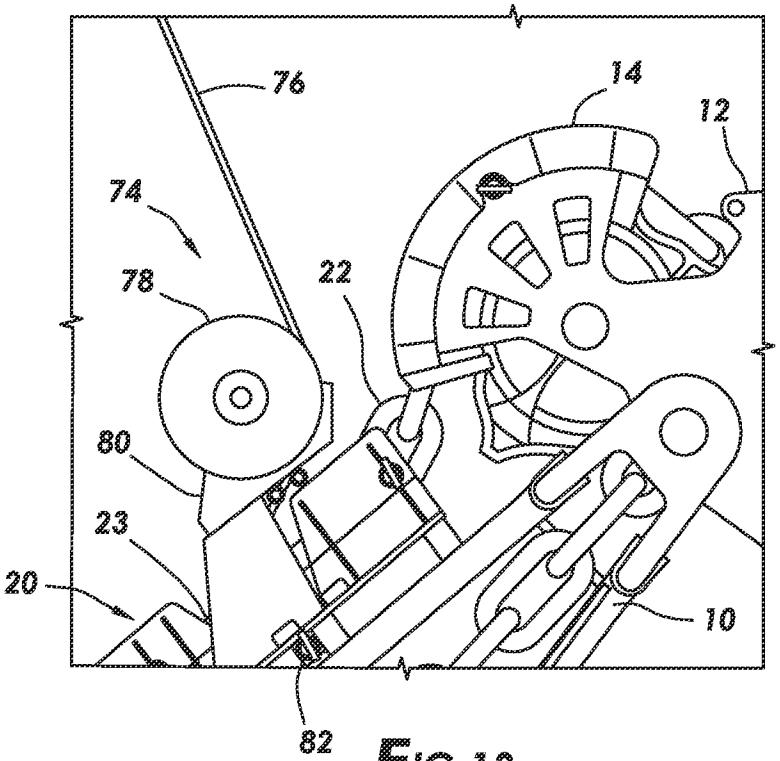
FIG. 13 depicts a temporary wire sheave coupled with the tail chain support for use in drawing tail chain onto the tail chain support.
Figure 14:
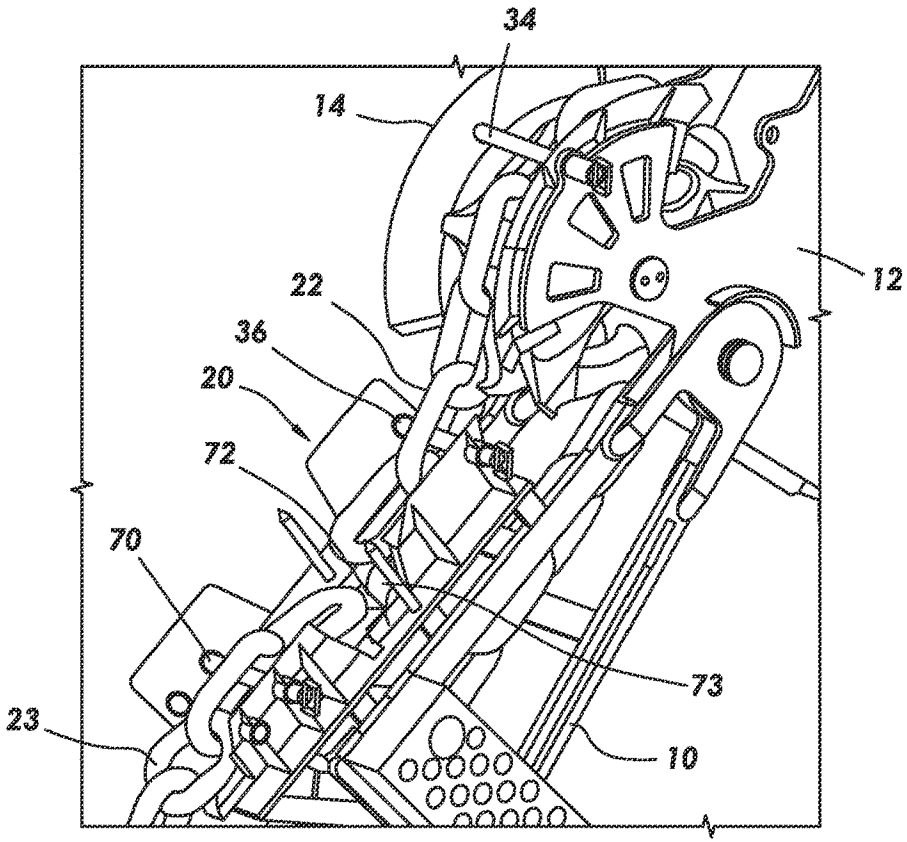
FIG. 14 depicts the fairlead stopper after tail chain is reconnected to the tail chain support with the insert piece coupled therewith.

In some embodiment, as shown in FIG. 13, additional chain, such as tail chain 23, is drawn to tail chain support 20 using a wire sheave 74. Wire sheave 74 includes wire 76 coupled with sheave 78 on frame 80. Wire 76 may extend from sheave 78 and engage with tail chain 23. Wire 76 may then be hauled-in, such as via a winch on an AHV, to bring tail chain 23 onto tail chain support 20. Frame 80 may be coupled and secured with tail chain support 20 and/or latch housing 10, such as via pin 82, during the reconnection of tail chain 23. Once tail chain 23 is hauled-in onto tail chain support 20, tail chain 23 is pinned thereto via pin 70, as shown in FIG. 14.

Figure 18:
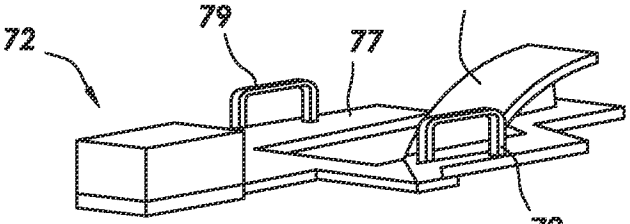
FIG. 18 depicts an insert piece in accordance with some embodiments.
Figure 15:
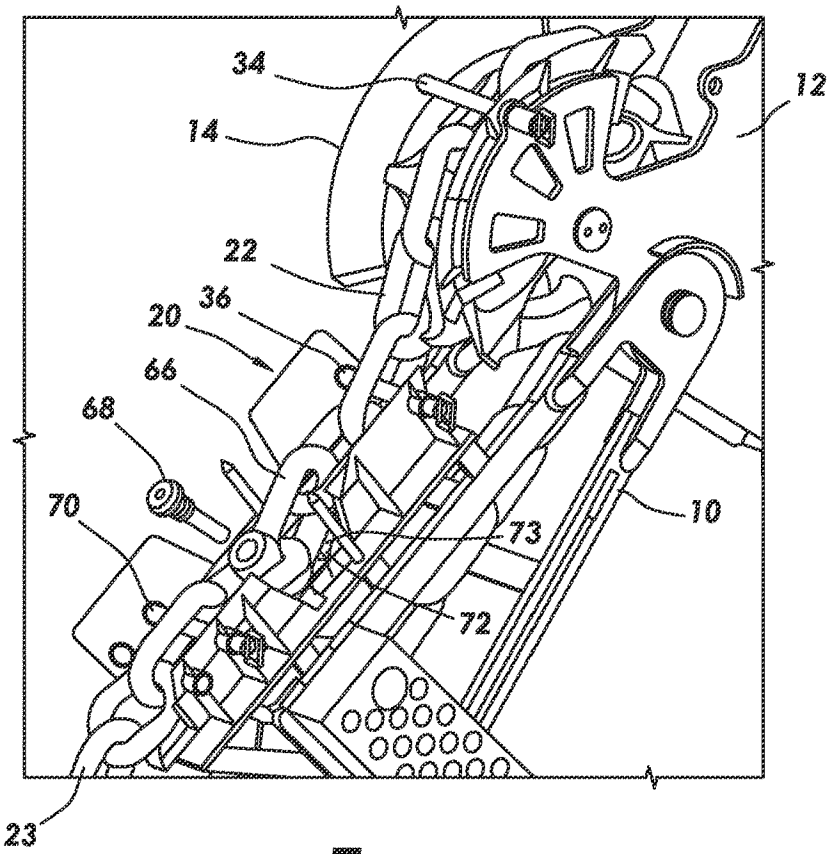
FIG. 15 depicts a removable chain link positioned to couple the tail chain with the mooring line.
Figure 17:
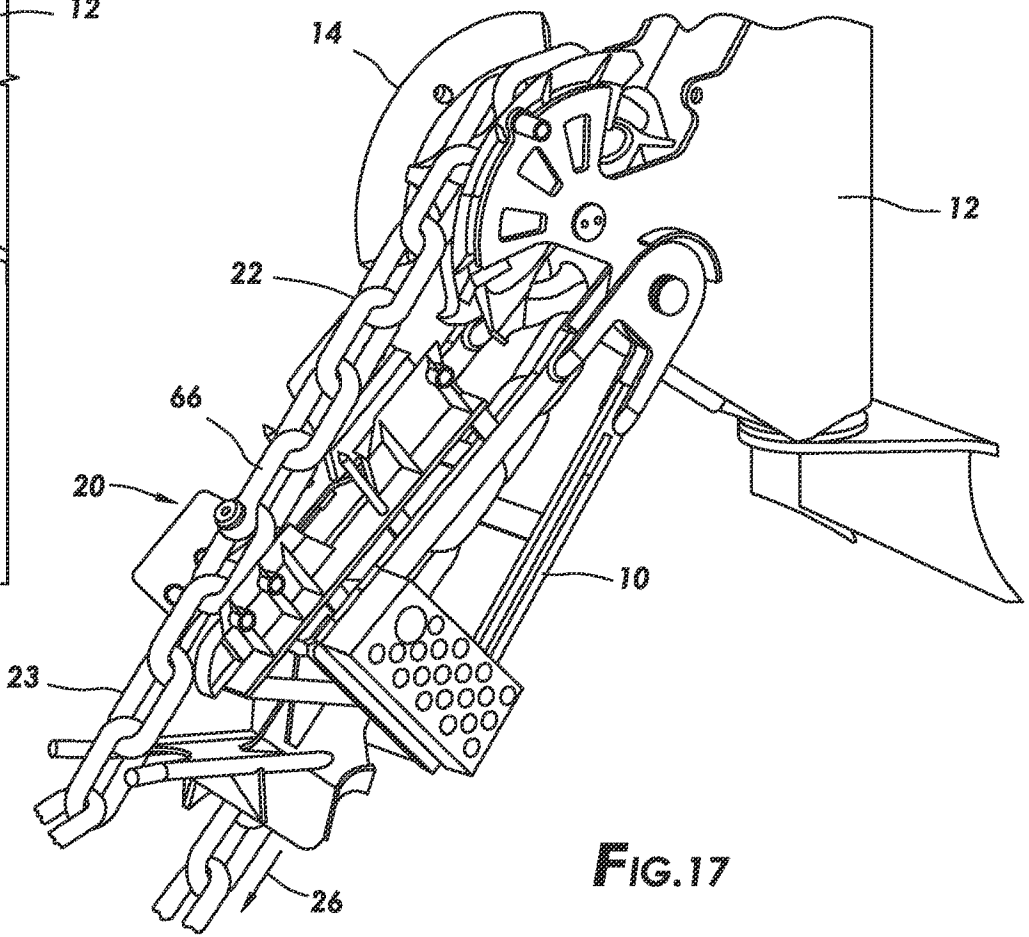
FIG. 17 depicts the fairlead stopper of FIG. 16 with the mooring line and tail chain released from the tail chain support.
Figure 16:
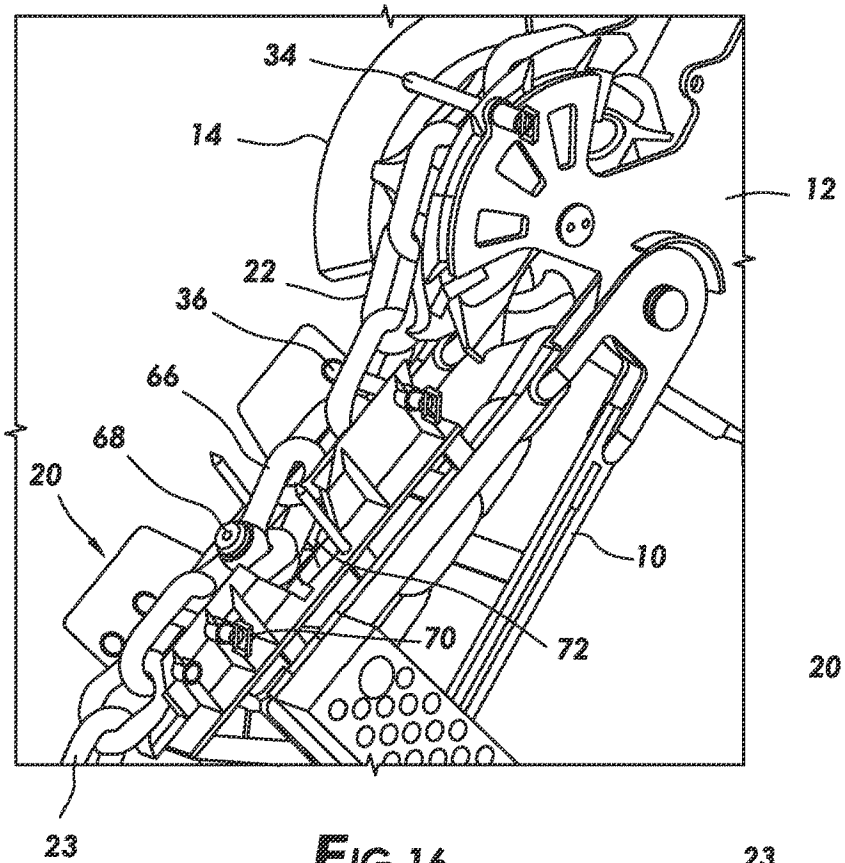
FIG. 16 depicts the tail chain coupled with the mooring line via the removable chain link.

With tail chain 23 secured to tail chain support 20, chain link 66 (e.g., a D-link) is lowered to tail chain support 20 and coupled with mooring chain 22. Alignment insert includes ramp 73 that positions chain link 66 for engagement with tail chain 23. Ramp 73 has a shape configured to bias chain link 66 into alignment with a chain link coupled with tail chain 23. Alignment insert 72 is depicted in FIG. 18, including ramp 73 projected upwards from frame 77, and including handles 79 coupled with frame 77 for handling insert 72. Chain link 66 is slid into place through a chain link of mooring chain and onto alignment insert 72, and ramp 73 biases link 66 such that link 66 is positioned to be secured to tail chain 23. As shown in FIG. 15, chain link 66 is secured to tail chain 23 via pin 68 inserted into chain link 66 and through a link of tail chain 23. One skilled in the art would understand that additional links of chain may be attached to mooring chain 22 via methods other than use of a D-link. Chain link 66 is shown connected with both mooring chain 22 and tail chain 23 in FIG. 16. After tail chain 23 is connected with mooring chain 22, mooring chain 22 and tail chain 23 are disconnected from tail chain support 20 via removal of pins 36 and 70, as shown in FIG. 17. Also, pin 34 securing chainwheel 14 to chainwheel housing 12 is removed such that chainwheel 14 is rotatable relative to chainwheel housing 12. With tail chain 23 and mooring chain 22, connected, released from tail chain support 20 and chainwheel 14 allowed to rotate, additional mooring line can be paid-out in direction 26. After paying-out additional mooring line, mooring chain 22 can be re-latched and the tail chain can be cut or otherwise disconnected as described in reference to FIGS. 1-10.

In some embodiments, rather than cutting a chain link, as shown in FIGS. 7A-7C, the mooring line includes one or more removable chain links, such as D-links, and removing tail chain includes removing a D-link that connects the mooring line with the tail chain. As used herein, a "removable chain link" is a chain link that can be removed (e.g., disconnected) from a length of chain without requiring cutting or otherwise breaking the chain link. For example, the dock of the tail chain support can be configured to receive an ROV that can use ROV manipulators to disconnect removable chain links.

In some embodiments, removal of the tail chain reduces weight in the catenary of the mooring line, minimizes the occurrence of twist in the mooring line, and eliminates complications for future reconnection due to having a long tail chain hanging in the water column.

While specific embodiments and equipment are shown and described herein, one skilled in the art would understand that the methods and systems disclosed herein are not limited to these particular embodiments described. One skilled in the art would understand that the order of some the steps described with reference to FIGS. 1-17 can be changed, that some steps may be eliminated, and that some steps can be added without departing from the scope of the present disclosure. Although the method is described in reference to a mooring line that is a chain, one skilled in the art would understand that the mooring line is not limited to be a chain. The mooring lines disclosed herein may include one or more sections of line, each of which may be composed of the same material or of different materials. The various segments of mooring lines may be coupled together via shackles, H-Links or other connectors. The mooring line may include a pile forerunner coupled with an anchor at seafloor. The anchor may be a suction pile, driven pile, drag embedment anchor, gravity anchor, torpedo anchor, or another type of anchor positioned at seafloor. The lower end of the mooring line may be pre-laid and wet stored on the seafloor at the site, prior to towing the vessel to the site, or may be laid on the seafloor after towing the vessel to the site.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A mooring system, the mooring system comprising:

a fairlead stopper, the fairlead stopper comprising a tail chain support that is positioned to receive tail chain of mooring chain;

wherein the tail chain support comprises a first chain coupler configured to secure mooring chain at a first position on the tail chain support and a second chain coupler configured to secure mooring chain at a second position on the tail chain support, wherein the first position is spaced apart from the second position.

2. The system of claim 1, wherein the first and second chain couplers comprise pin holes and pins, wherein the pins are engageable through the pin holes and through mooring chain links to secure mooring chain to the tail chain support.

3. The system of claim 1, wherein the tail chain support further comprises a dock positioned between the first and second positions, wherein the dock is configured to couple with a tail chain handling tool.

4. The system of claim 3, wherein the dock comprises docking pins configured to engage within docking funnels on the tail chain handling tool.

5. The system of claim 3, wherein the tail chain handling tool comprises a remotely operative vehicle, a chain cutter, or combinations thereof.

6. The system of claim 1, wherein the fairlead stopper comprises a latch housing comprising chain latches configured to latch mooring chain links to secure a position of mooring chain relative to the fairlead stopper; and a chainwheel housing coupled with the latch housing and comprising a chainwheel rotatably coupled thereto, wherein the chainwheel is configured to guide mooring chain through the fairlead stopper.

7. The system of claim 6, wherein the chainwheel housing comprises a third coupler configured to secure a position of the chainwheel relative to the chainwheel housing.

8. The system of claim 7, wherein the third coupler comprises a pin and pin holes through the chainwheel housing and through the chainwheel, wherein the pin is engageable through the pin holes to prevent rotation of the chainwheel relative to the chainwheel housing.

9. The system of claim 1, further comprising mooring chain coupled with the fairlead stopper and secured to the tail chain support by the first and second chain couplers, wherein the first position is spaced apart sufficiently from the second position such that at least one link of the mooring chain is positioned between the first and second positions.

10. The system of claim 9, wherein the at least one chain link comprises a removable chain link.

11. The system of claim 1, further comprising an alignment insert configured to couple with the tail chain support between the first and second positions, wherein the alignment insert has a shape that is configured to bias a chain link coupled with mooring chain that is secured by the first chain coupler into engagement with a chain link coupled with tail chain that is secured by the second chain coupler.

12. The system of claim 11, wherein the alignment insert comprises a frame and a ramp on the frame, wherein the ramp biases a chain link coupled with mooring chain that is secured by the first chain coupler into alignment with a chain link coupled with tail chain that is secured by the second chain coupler.

13. The system of claim 1, further comprising a chain retrieval tool configured to draw additional chain to the tail chain support for coupling with mooring chain, the chain retrieval tool comprising a frame, a sheave coupled with the frame, and a wire coupled with the sheave, wherein the frame is securable to the fairlead stopper.

14. A moored system, the moored system comprising:

a floating vessel;

a fairlead stopper coupled with the floating vessel;

a mooring chain coupled with the fairlead stopper and with an anchor;

wherein the fairlead stopper comprises a tail chain support that is positioned to receive tail chain of the mooring chain;

wherein the tail chain support comprises a first chain coupler and a second chain coupler, wherein the mooring chain is secured to the tail chain support by the first and second chain couplers, and Wherein at least one link of the mooring chain is positioned between the first and second chain couplers.

15. A method of mooring a floating vessel, the method comprising:

paying-out a mooring chain from a fairlead stopper coupled with the floating vessel, hauling-in the mooring chain to the fairlead stopper, or combinations thereof, until the mooring chain has a first tension;

securing the mooring chain at the first tension with the fairlead stopper;

with the mooring chain secured at the first tension, securing a tail chain of the mooring chain to a tail chain support of the fairlead stopper, wherein securing the tail chain comprises securing a first chain link of the tail chain at a first position on the tail chain support and securing a second chain link of the tail chain at a second position on the tail chain support, wherein at least one chain link of the tail chain is positioned between the first and second chain links; and with the tail chain secured to the fairlead stopper, removing the at least one chain link positioned between the first and second chain links, wherein, after removing the at least one chain link, the first chain link is coupled with the mooring chain and the second chain link is coupled with a length of the tail chain that is disconnected from the mooring chain.

16. The method of claim 15, wherein securing the first and second chain links on the tail chain support comprises pinning the first and second chain links to the tail chain support.

17. The method of claim 15, wherein removing the at least one chain link positioned between the first and second chain links comprises cutting the at least one chain link.

18. The method of claim 17, wherein the tail chain support comprises a dock, and wherein cutting the at least one chain link comprises docking a chain cutter onto the dock and cutting the at least one chain link with the chain cutter.

19. The method of claim 18, wherein docking the chain cutter comprises engaging docking funnels on the chain cutter with docking pins on the dock.

20. The method of claim 18, further comprising controlling the chain cutter with a remotely operated vehicle.

21. The method of claim 15, wherein the at least one chain link positioned between the first and second chain links comprises a removable chain link, and wherein removing the removable chain link comprises disconnecting the removable chain link from the first and second chain links.

22. The method of claim 15, further comprising, after removing the at least one chain link positioned between the first and second chain links, disconnecting the second chain link from the second chain coupler and removing the length of the tail chain that is disconnected from the mooring chain.

23. The method of claim 22, further comprising, after removing the length of the tail chain that is disconnected from the mooring chain:

attaching an additional length of chain to the mooring chain;

releasing the mooring chain, with the additional length of chain attached thereto, from the tail chain support;

hauling-in or paying-out the mooring chain having the additional length of chain attached thereto until the mooring chain has a second tension; and securing the mooring chain at the second tension with the fairlead stopper.

24. The method of claim 23, wherein the first tension is different than the second tension.

25. The method of claim 23, wherein the additional length of chain is the length of the tail chain previously disconnected from the mooring chain.

26. The method of claim 23, wherein attaching the additional length of chain comprises securing the additional length of chain to the tail chain support, and securing a chain link coupler to the mooring chain and to the additional length of chain.

27. The method of claim 26, wherein the chain link coupler comprises a D-link.

28. The method of claim 26, further comprising positioning an alignment insert on the tail chain support between the additional length of chain and the mooring chain, wherein securing the chain link coupler comprises:

securing the chain link coupler to a chain link of the mooring chain;

positioning the chain link coupler on the alignment insert, wherein the alignment insert biases the chain link coupler into alignment with a chain link of the additional length of chain; and securing the chain link coupler to the chain link of the additional length of chain.

29. The method of claim 23, further comprising, prior to attaching the additional length of chain to the mooring chain, securing the additional length of chain to the tail chain support.

30. The method of claim 29, further comprising, prior to attaching the additional length of chain to the mooring chain, retrieving the additional length of chain by:

coupling a chain retrieval tool to the tail chain support, the chain retrieval tool comprising a frame, a sheave coupled with the frame, and a wire coupled with the sheave;

coupling the wire with the additional length of chain; and pulling the additional length of chain with the wire until the additional length of chain is positioned on the tail chain support.

* * * * *